US009919316B2

(12) United States Patent
Glebov et al.

(10) Patent No.: US 9,919,316 B2
(45) Date of Patent: Mar. 20, 2018

(54) METHOD FOR FORMING A HIGH-GRADIENT MAGNETIC FIELD AND A SUBSTANCE SEPARATION DEVICE BASED THEREON

(71) Applicant: Giamag Technologies AS, Kjeller (NO)

(72) Inventors: Vladimir Alexandrovich Glebov, Moscow (RU); Alexey Vladimirovich Glebov, Moscow (RU); Evgeny Ivanovich Ilyashenko, Moscow (RU); Arne Torbjørn Skjeltorp, Ski (NO); Tom Henning Johansen, Oslo (NO)

(73) Assignee: Giamag Technologies AS, Kjeller (NO)

( * ) Notice: Subject to any disclaimer, the term of this patent is extended or adjusted under 35 U.S.C. 154(b) by 237 days.

(21) Appl. No.: 14/734,813

(22) Filed: Jun. 9, 2015

(65) Prior Publication Data

US 2015/0266030 A1 Sep. 24, 2015

Related U.S. Application Data

(62) Division of application No. 11/793,930, filed as application No. PCT/RU2004/000514 on Dec. 22, 2004, now Pat. No. 9,073,060.

(51) Int. Cl.

| | |
|---|---|
| ***B03C 1/033*** | (2006.01) |
| ***B03C 1/035*** | (2006.01) |
| ***B03C 1/22*** | (2006.01) |

(52) U.S. Cl.

CPC ..... *B03C 1/0332* (2013.01); *B03C 1/035* (2013.01); *B03C 1/22* (2013.01); *B03C 2201/22* (2013.01); *Y10T 29/4902* (2015.01)

(58) Field of Classification Search

CPC .... H01F 7/0205; H01F 7/0273; H01F 7/0278; H01F 7/0294; H01F 3/14;

(Continued)

(56) References Cited

U.S. PATENT DOCUMENTS 4,047,814 A * 9/1977 Westcott ..... G01N 33/2835 209/214
4,806,858 A * 2/1989 Elbicki ..... G02F 1/1313 324/205

(Continued)

FOREIGN PATENT DOCUMENTS

SU 526388 A * 10/1976

OTHER PUBLICATIONS

English language machine translation of SU 526388.*

(Continued)

*Primary Examiner* — David C Mellon
(74) *Attorney, Agent, or Firm* — Osha Liang LLP

(57) ABSTRACT

A method of creating a zone of high-gradient magnetic field in a Kittel open domain structure is disclosed. The method is based on a magnetic system of an open domain structure type and is embodied in the form of two substantially rectangular constant magnets which are mated by the side faces thereof, whose magnetic field polarities are oppositely directed and the magnetic anisotropy is greater than the magnetic induction of the materials thereof. The magnets are mounted on a common base comprising a plate which is made of a non-retentive material and mates with the lower faces of the magnets, thin plates which are made of a non-retentive material, are placed on the top faces of the magnets and forms a gap arranged above the top edges of the magnets mated faces. A nonmagnetic substrate for separated material is located above the gap.

12 Claims, 6 Drawing Sheets

(58) Field of Classification Search
CPC . H01F 2003/103; B03C 1/0332; B03C 1/035; B03C 1/22; B03C 2201/22
See application file for complete search history.

(56) References Cited

U.S. PATENT DOCUMENTS

| | | | | | |
|---|---|---|---|---|---|
| 5,053,344 | A * | 10/1991 | Zborowski et al. | 436/177 | |
| 5,340,749 | A * | 8/1994 | Fujiwara | G01N 33/54326 | 435/29 |
| 5,458,785 | A * | 10/1995 | Howe et al. | 210/695 | |
| 5,498,550 | A * | 3/1996 | Fujiwara | G01N 33/54326 | 210/222 |
| 5,976,369 | A * | 11/1999 | Howe | B03C 1/035 | 210/222 |
| 5,985,153 | A * | 11/1999 | Dolan | B01L 3/502 | 209/214 |
| 6,182,831 | B1 * | 2/2001 | Scheidemann et al. | 209/213 | |
| 7,474,184 | B1 * | 1/2009 | Humphries | B03C 1/002 | 335/296 |
| 7,776,221 | B2 * | 8/2010 | Brassard | 210/695 | |
| 2004/0004043 | A1 * | 1/2004 | Terstappen | B01L 3/502 | 210/695 |

OTHER PUBLICATIONS

Samofalov, V.N., et al.; "Strong magnetic stray fields in systems of highly anisotropic mangets", Physics of Metals and Metallurgical Science, 2004, vol. 97, No. 3, pp. 15-23.*

* cited by examiner

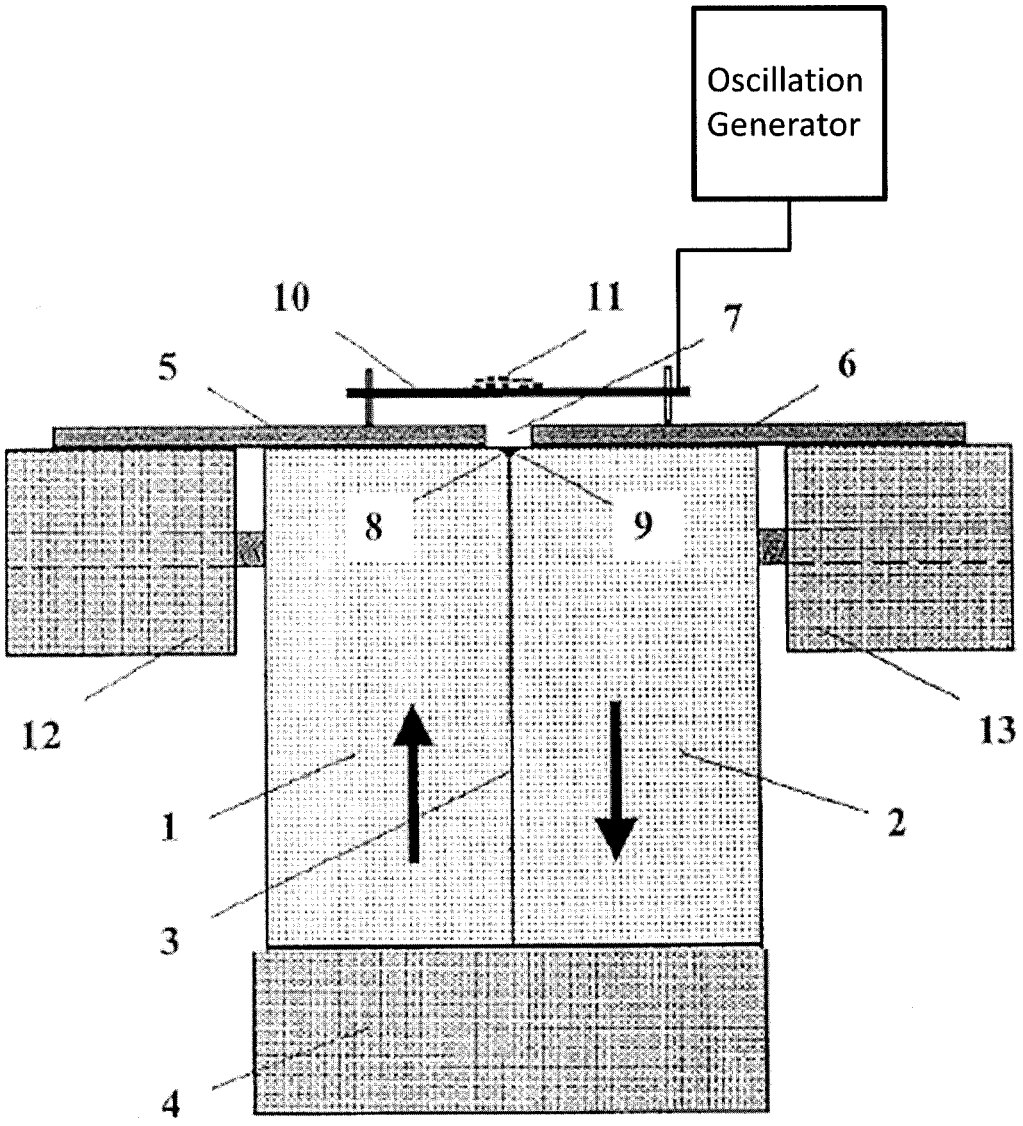
Fig. 6A
Fig. 6B
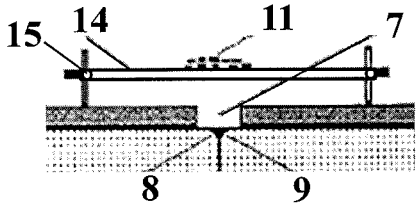

METHOD FOR FORMING A HIGH-GRADIENT MAGNETIC FIELD AND A SUBSTANCE SEPARATION DEVICE BASED THEREON

CROSS-REFERENCE TO RELATED APPLICATIONS

This application is a divisional application and claims the benefit under 35 U.S.C. § 120 of U.S. patent application Ser. No. 11/793,930, filed on Jun. 22, 2007, which is a national stage application of PCT/RU04/00514, filed on Dec. 22, 2004.

TECHNICAL FIELD

Embodiments of the invention relate to methods and devices of magnetic separation and it is intended for: a) the separation of paramagnetic substances from diamagnetic ones, b) the division of paramagnetic substances depending on their paramagnetic susceptibility, and c) the division of diamagnetic substances depending on their diamagnetic susceptibility. Possible fields of application of the embodiments of the invention are production of clean and super pure substances and materials in electronics, metallurgy and chemistry, separation of biological subjects (red blood cells, "magnetic bacteria", etc.) in biology and medicine, removal of heavy metals and organic impurities from water, etc.

BACKGROUND ART

The basic factor of magnetic separation is the magnetic force, which acts on a particle of the substance and which is proportional to the magnetic susceptibility of the substance, the value of the magnetic induction B and the value of the gradient ∇B of the applied magnetic field. Therefore, increasing the sensitivity and selectivity of magnetic separation will require use of the highest possible values of magnetic induction and magnetic field gradient, or their united factor—the product B∇B.

It is known a magnetic separator intended for the separation of ferromagnetic materials in terms of the values of their magnetic susceptibility which makes it possible to reach a value of the product B∇B of about $4.5\cdot10^5$ $mT^2/m$ in a gap of a few millimeters [1]. However, this magnetic separator cannot be used for the separation of paramagnetic and diamagnetic substances and materials, because the values of the magnetic field parameters are not high enough.

It is known a magnetic system which consists of two permanent magnets with opposite magnetization in the form of a Kittel open domain structure [2]. In this system, near the edges of the faces of the joining magnets, a strong magnetic stray field appears which is caused by the non-diagonal matrix elements of the demagnetization factor tensor (see FIG. 1), and the value of the product B∇B reaches $10^{11}$ $mT^2/m$. On the surface of magnets, in the zone of the upper edges of the joining faces (in the zone of line 0Y in FIG. 1), a strong magnetic stray field appears with the components Hy(x,z), Hz(x,z) and Hx(x,z). The component Hy(x,z) is equal to zero due to the geometry of the system, the vertical component Hz(x,z) comprises less than half the value of the induction of the magnet material, and the horizontal component Hx(x,z), which in the present case is of greatest interest, can be described by the expression:

$$Hx(x,z)=Ms[\ln(a^2+z^2+2ax+x^2)-2\ln(x^2+z^2)+\ln(a^2+z^2-2ax+x^2)],$$ wherein:

Ms is the magnetization saturation of the magnets, and a is the size of the magnet along the 0x axis (see FIG. 1).

It follows from this expression that on the plane z=0, at point 0 the horizontal component of the stray field strives into infinity. As a result, in a small area $-0.1a\leq x\leq 0.1a$, along the line of the joining magnets the horizontal component of the magnetic stray field makes an abrupt jump, which is noted by a dotted line in FIG. 1, the intensity of which can be several times stronger than the induction of the magnet material.

The important practical feature of the magnetic system described is the fact that the stray field Hx(x,z) possesses a high gradient, which in the area near to the point 0 can reach a values of $10^6$–$10^9$ mT/m. In this system the value of the product B∇B reaches $10^{11}$ $mT^2/m$. The disadvantage of this magnetic system is the impossibility of controlling the form and gradient of the created magnetic fields which causes the practical impossibility of using this system for the separation of substances and materials.

A high-gradient magnetic separator is known, which makes it possible to reach a value of the product B∇B of about $1.3\cdot10^{10}$ $mT^2/m$ in a gap of a few micrometers [3]. The disadvantage of this separator is the necessity of introducing ferromagnetic bodies, (wires, balls, and the like) with a size of 25-60 μm into the substances being analyzed, this fact substantially limiting the possible range of properties and characteristics of the substances to be separated.

A device for continuous removal of impurities from colloidal dispersions, which contain pathogenic components, such as viruses and microbes, is known [4]. The device is supplied with at least one magnet with a central core, the poles of which are turned to one another and located in such a way that they form a channel with a magnetic field, which is perpendicular to their surfaces. In the channel there is a basket in the shape of a tray of rectangular cross-section and made from non-magnetic material, in which a filter is established from a material with high magnetic permeability, in the form of untied fibres, wires, net-like cloths or powders, which makes it possible to create a high gradient magnetic field. One side of the basket and filter communicates with a chamber for supplying the solution, and the other—with a chamber for collecting the filtered liquid. The disadvantage of this device is the necessity of introducing ferromagnetic bodies in the form of the filter, into the substances being analyzed and the impossibility of its application for the separation of non-liquid substances.

A magnetic system is known, for magnetic separation of biological substances by the method of sedimentation of particles, which can be magnetized, from the suspension [5]. This magnetic system includes a carrier plate, on which an iron plate is fixed, and a number of permanent magnets mounted on the iron plate, the polarity of each magnet being opposite of the polarity of the adjacent magnet. A magnetic field concentrator plate of iron is overlying the magnets and a cover plate is disposed above the field concentrator plate. A hole is provided in the cover plate and field concentrator plate for locating in the magnetic field, tubes with the suspension being separated. The plate of the magnetic field concentrator has a smooth external surface and a cone-shaped cross-section, such that the thickness of the plate decreases towards the holes. The disadvantage of this magnetic system is the impossibility of achieving such parameters of the magnetic field that would allow using it for the separation paramagnetic substances in terms of the magnitudes of their paramagnetic susceptibility.

SUMMARY OF INVENTION

The device according to one or more embodiments of the invention are designed in order to create strong and high gradient magnetic fields with adjustable form and a gradient in the zone of separation, for use as a high-sensitivity magnetic separator for separation of different types of paramagnetic substances and materials from diamagnetic ones, for division of the paramagnetic substances and materials in terms of the magnitudes of their paramagnetic susceptibility, and also for division of the diamagnetic substances and materials in terms of the, magnitudes of their diamagnetic susceptibility.

One or more embodiments of the method of creating a high gradient magnetic field, which is formed in the Kittel open domain structure above the free edges of the mating faces of two magnets with opposite directions of the polarity of the magnetic field, the magnetic anisotropy may substantially exceed the magnetic induction of the magnet material. The dimensions of the zone are set by thin magnetic soft-iron plates, which are placed on the free faces of the magnets such that they form a narrow gap located immediately above the upper edges of the mating faces of the magnets.

One or more embodiments of the invention may include a device for magnetic separation of substances based on a magnetic system made as an open domain structure which consists of two permanent magnets, the lateral sides of which are joined, the shape of the magnets, as a rule, being rectangular with opposite directions of their magnetic field polarity, and their magnetic anisotropy substantially exceeding the magnetic induction of the magnet material. The magnets are mounted on a common base which includes the magnetic plate made from soft-iron material and joined with the lower sides of the magnets. On the upper sides of the magnets thin plates of magnetic soft material which form a narrow gap, are located immediately above the upper edges of the mating faces of the magnets, and immediately above the gap, a non-magnetic substrate for the material being separated.

In a particular embodiment of the invention the thin plates are made of a magnetic soft material, such as vanadium permendur.

In another particular embodiment of the invention the thin plates are made with a thickness from 0.01 to 1.0 mm.

In another particular embodiment of the invention the thin plates are provided with means for their displacement along the surfaces of the upper sides of the magnets in order to regulate the size of the gap between 0.01 and 1.0 mm, located symmetrically relative to the plain of the joining magnets.

In another particular embodiment of the invention the substrate is made as a thin band or tape of non-magnetic material, such as polyester.

In another particular embodiment of the invention the band is provided with means for its displacement along a direction perpendicular to the longitudinal axis of the gap.

In another particular embodiment of the invention the substrate is made as a non-magnetic plate connected to a source of mechanical oscillations.

In another particular embodiment of the invention the magnets are made of such materials as Nd—Fe—B, Sm—Co, or Fe—Pt.

In another particular embodiment of the invention the device is formed on the basis of two or more magnetic systems as a series of joining faces of three or more magnets, the zones of separation having the form of two or more slots above the upper edges of the mating faces.

The upper edges of the mating faces of the magnets are the zones of magnets which directly adjoin the line of intersection of two planes, one of them being the plane along which the lateral sides of magnets are mated, and the other the plane of the upper sides of the magnets (see numerals 8 and 9 in FIG. 6).

One or more embodiments of the invention may provide the ability to considerably increase the magnitude of the product B∇B in the zone of separation and also regulate the product B∇B, which gives the practical possibility of using the high magnetic stray fields for the creation of a high-sensitivity magnetic separator.

The illustrations in FIGS. 2 and 3, and also FIGS. 4 and 5, demonstrate the change in the magnetic field configuration compared to the known open domain structure [1], that is achieved due to embodiments of the invention. The presented illustrations show that with the magnetic system according to one or more embodiments of the invention it is achieved not only a concentration of the magnetic field in the zone formed by the gap between the plates, but also a change in the shape of the magnetic force lines, as well as in the magnitude and distribution of the magnetic induction nearby the edges of the joined sides of the magnets. Thus, one or more embodiments of the invention makes it possible to change the parameters of the magnetic field considerably, and to create the most suitable conditions for the separation of materials over a wide range of their magnetic properties, including the separation of paramagnetic substances and materials in terms of the magnitudes of their paramagnetic susceptibility, and the separation of diamagnetic substances and materials in terms of the magnitudes of their diamagnetic susceptibility.

BRIEF DESCRIPTION OF DRAWINGS

FIG. 6A is an illustration of the of the magnetic system according to the present invention, and FIG. 6B is an illustration of part of the magnetic system in accordance with one or more embodiments of the invention.

DETAILED DESCRIPTION

Figure 1:
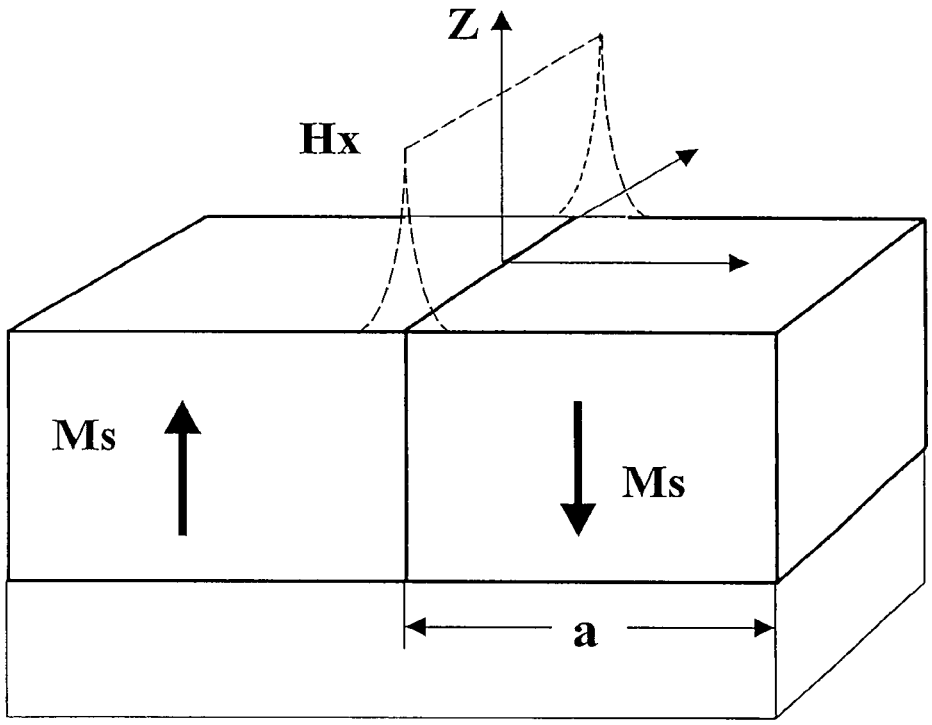
FIG. 1 is an illustration of the Kittel open domain structure of two magnets.
Figure 2:
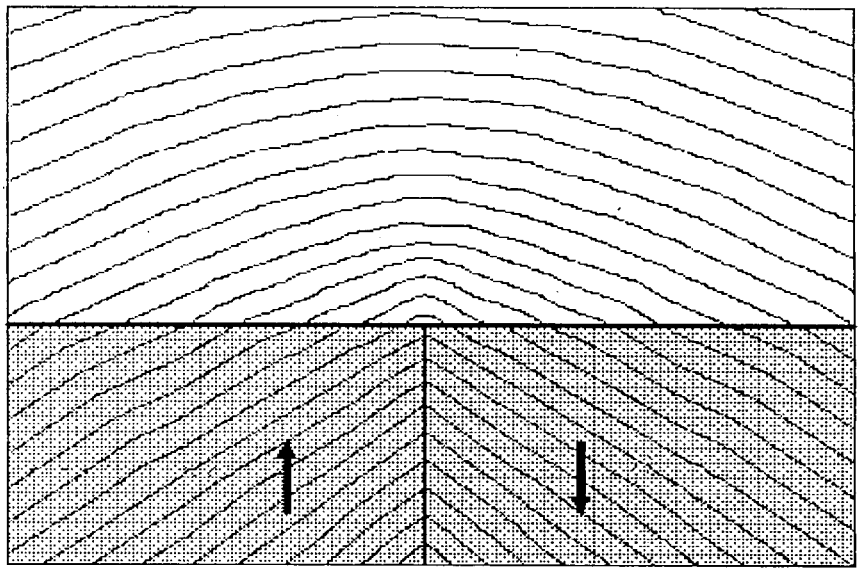
FIG. 2 presents a schematic diagram of the magnetic force lines in the Kittel open domain structure.
Figure 3:
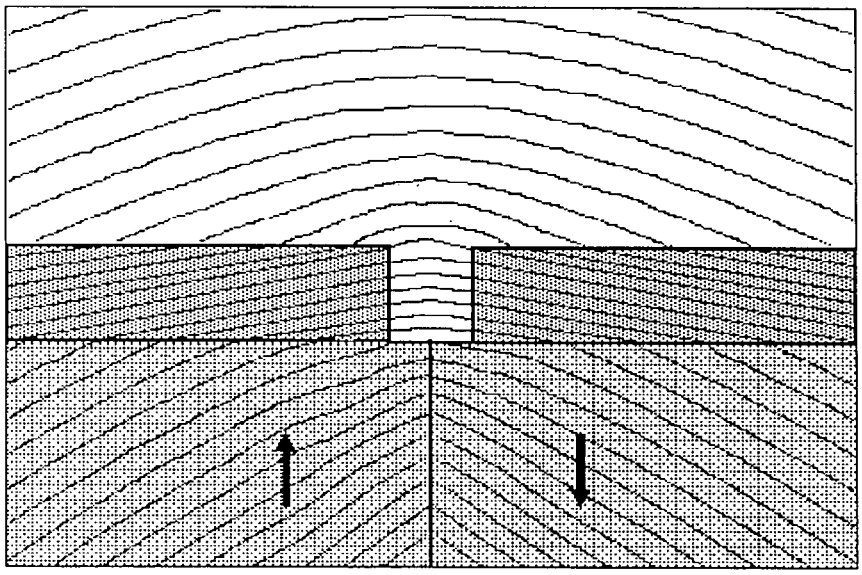
FIG. 3 presents a schematic diagram of the magnetic force lines in the magnetic system according to the present invention.
Figure 4:
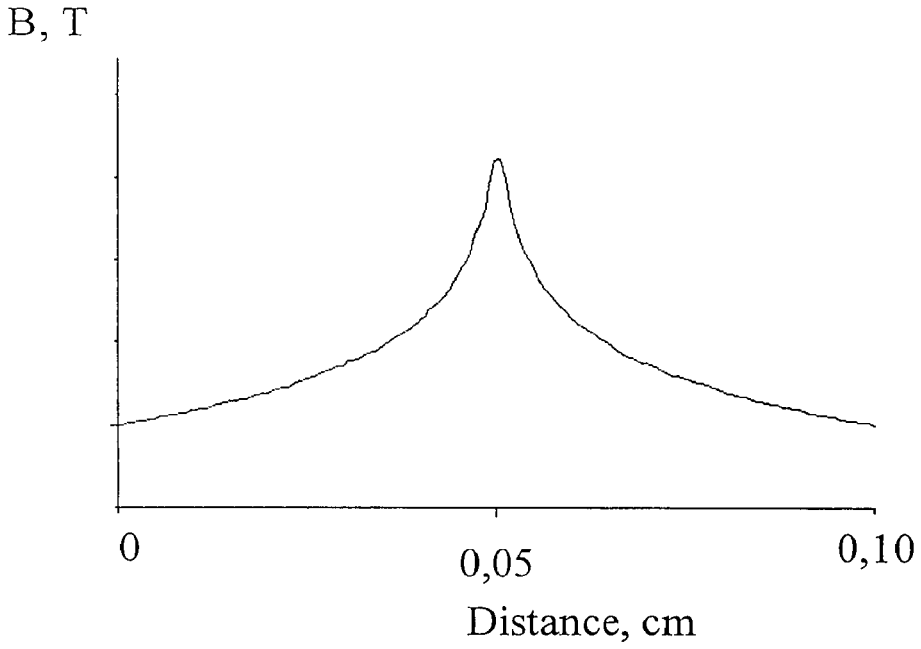
FIG. 4 is a graph showing the variation in the horizontal component of the magnetic induction nearby the edges of the joined magnets in the Kittel open domain structure.
Figure 5:
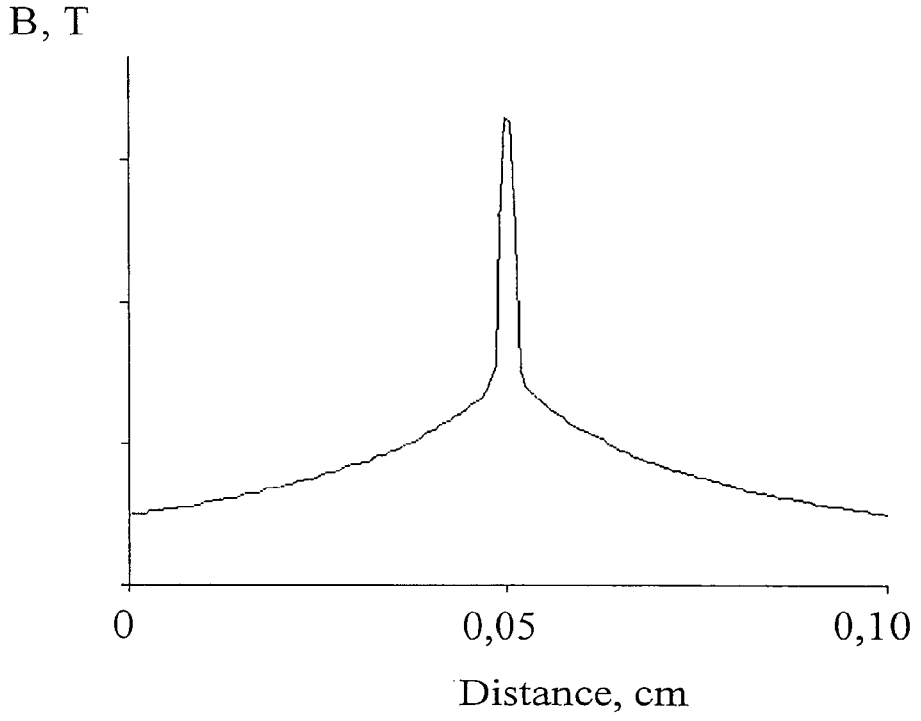
FIG. 5 is a graph showing the variation in the horizontal component of the magnetic induction nearby the edges of the joined magnets in the magnetic system according to the present invention.

The disclosed device (see FIG. 6) consists of two magnets 1 and 2 of a predominantly rectangular shape, with opposite directions of magnetization (shown by arrows in the figure). The magnets are made of a material with a much greater magnetic anisotropy than the induction of a material of magnets, such as neodymium-iron-boron, iron-platinum or samarium-cobalt, for example.

In experiments sintered neodymium-iron-boron magnets were used with a remnant induction of about 1.3 T, an intrinsic coercive force of magnetization of about 1300 kA/m, and a maximum energy product of about 320 kJ/$m^3$. The size of magnets was 25×50×50 mm.

The magnets 1 and 2 are joined together along a plane 3 and and their lower sides placed on a basis 4 in the form of a plate made of soft-iron material, for example, with a thickness of 5-25 mm.

On the upper sides of the magnets 1 and 2, thin plates 5 and 6 are located which are made of a magnetic soft material with high magnetic saturation induction, their thickness being 0.01-1.0 mm. The thickness of plates 5 and 6 should be chosen depending on the required magnitudes of the magnetic induction and the optimum field gradient for the separation of real substances and materials. The plates 5 and 6 are located on the upper sides of the magnets 1 and 2 with a clearance forming a narrow gap 7 which is 0.01-1.0 mm wide immediately above the upper edges 8 and 9 of the magnets 1 and 2, as a rule, symmetrically relative to a plane 3. Immediately above the gap 7 there is a non-magnetic substrate 10 for the placing of the material being separated 11. The substrate 10 can be made as a horizontal plate, for example, connected to a generator of mechanical oscillations. The substrate can also be made as a thin non-magnetic, band 14 (of polyester, for example) and be provided with means to move the band 15 along a direction perpendicular to the longitudinal axis of the gap 7 (the band and its moving means are shown in FIG. 6B). The substrate 10 can be provided with means to displace it a distance of 0-5 mm from the surface of the plates 5 and 6. The plates 5 and 6 are connected to the means 12 and 13 for moving them along the upper sides of the magnets 1 and 2 in order to regulate the width of the gap over a range of 0.01-1.0 mm.

The device makes it possible to create strong magnetic fields with a magnitude of the product B∇B of more than $4\cdot10^{11}$ $mT^2/m$ at a distance less than 10 μm from the surface of the plates 5 and 6, forming the gap. Thus, for a particular embodiment of the device, where vanadium permendur plates with a thickness of 0.20 mm are being used and the gap width is 0.05 mm, the tangential component of the magnetic field induction exceeds 4.0 T. Furthermore, the peak width of the magnetic field tangential component can be regulated by the width of the gap 7.

Figure 7:
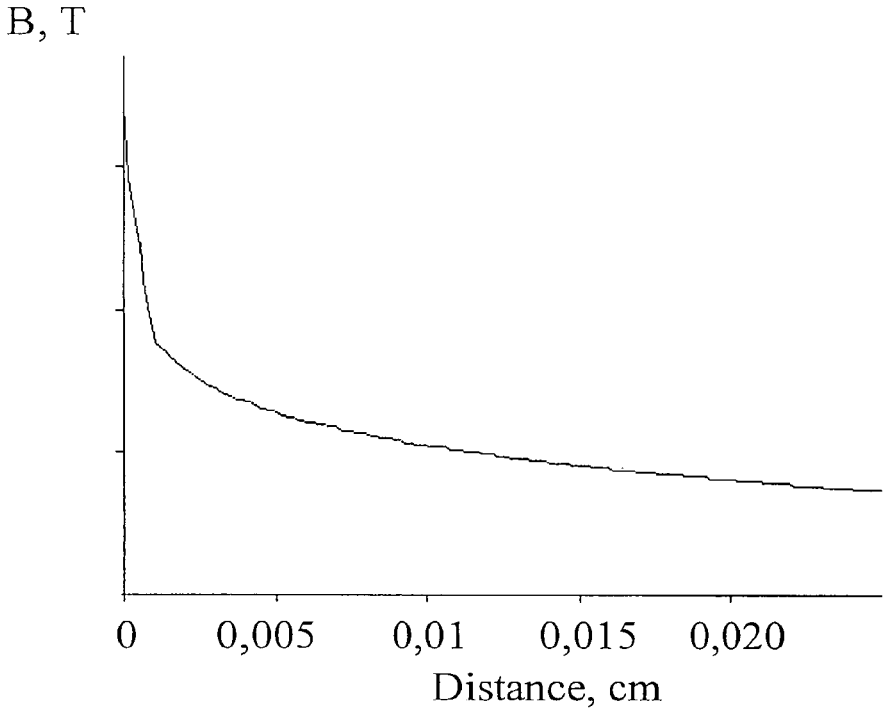
FIG. 7 is a graph showing the dependence of the magnetic field induction in the gap zone, on the distance from the surface of the plates.

FIG. 7 shows the dependence of the magnetic field induction on the distance from the axis perpendicular to the plane of the plates 5 and 6. The origin of coordinates in FIG. 7 corresponds to a point in the center of the gap 7 at the level of the plates 5 and 6. At a distance of 0.10 mm from this point the gradient is $4.1\cdot10^6$ mT/m, and at a distance of 0.01 mm $1.2\cdot10^8$ mT/m, while the product B∇B is $4.2\cdot10^{11}$ $mT^2/m$.

The experimental examination of the possibility to separate paramagnetic substances using the disclosed device was carried out on a mixture of substances with different paramagnetic susceptibility. The results are presented in the following table.

TABLE 1

The separation of a mixture of substances with different paramagnetic susceptibility

| Substance | Susceptibility [$\chi \cdot 10^6$] | Distance [mm] |
|---|---|---|
| Dysprosium sulfate | 92760 | 1.900 |
| Europium chloride | 26500 | 0.700 |
| Copper chloride | 1080 | 0.100 |

The separation process was conducted as follows: The mixture of the substances presented in the table above, was placed on a thin polyester band, which was located at a fixed distance from the plates 5 and 6. Then the band was moved above the surface of the plates along a direction perpendicular to the longitudinal axis of the gap 7. The particles of dysprosium sulfate, which possess the greater magnetic susceptibility, were separated from the mixture, when the distance between the band and the plates 5 and 6 was about 1.90 mm, while the other particles of the mixture continued to move on together with the band. Then the separated particles of dysprosium sulfate were removed from the band, the distance between the band and the plates 5 and 6 was decreased, and the separation process was continued.

The table presents the magnitudes of distances from the band to the surface of the plates 5 and 6, which correspond to the separation of all the components of the paramagnetic substances mixture.

Figure 8:
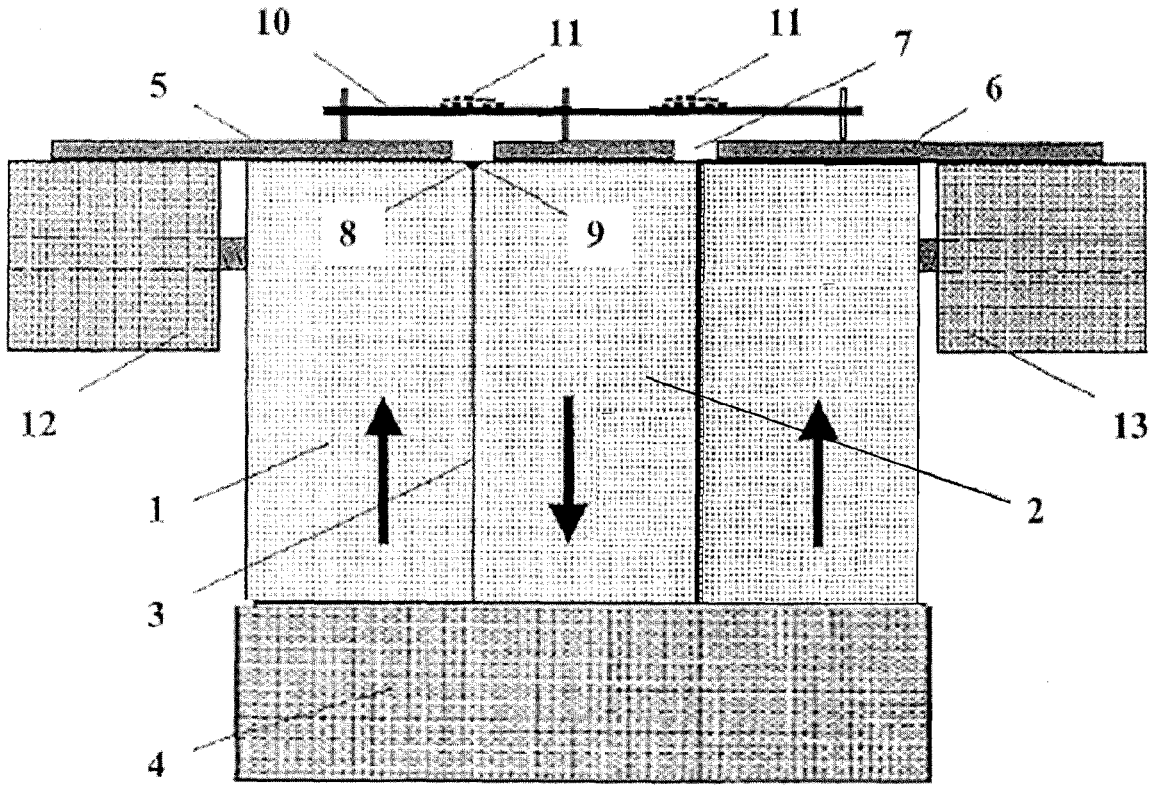
FIG. 8 is an illustration of the magnetic system in accordance with one or more embodiments of the invention.

On the basis of the magnetic system with two magnets according to the invention, a more productive magnetic separator can be created, as a composition of two or more analogous magnetic systems. Each system should be formed by a serial joining of the faces of the three or more magnets, with separation zones in the vicinity of two or more gaps formed by the plates above the upper edges of the mating faces, as shown in FIG. 8. In a system of four magnets and three separation zones, a three-stage separation of substances could be executed during one passage of the band with substances being separated.

Thus, embodiments of the invention makes it possible to create strong magnetic fields with a very high magnitude of the product B∇B, i.e. of more than $4\cdot10^{11}$ $mT^2/m$, at a distance less than 10 μm from the surface of the plates forming the gap. The device makes it possible to regulate the shape and gradient of the magnetic field in the zone of separation. In practice, the invention can be used for the separation of paramagnetic substances and materials from diamagnetic ones, for division of paramagnetic substances and materials in terms of the magnitudes of their paramagnetic susceptibility, and for division of diamagnetic substances and materials in terms of the magnitudes of their diamagnetic susceptibility. The substances can be both in the form of powders and in the form of colloidal solutions and suspensions.

BIBLIOGRAPHIC DATA

1. Glebov, V. A.; Glebov, A. V.; Knyazev, Yu. D.; Nefedov, V. S.; Lileyev, A. S: "Magnetic separation of fast-hardened powders of neodymiumironboron systems"; Proceedings of VUZ—Institute of Higher Education; Materials of Electronic Engineering, No. 4, 2003, pp. 59-61.
2. Samofalov, V. N.; Ravlik, A. G.; Belozorov, D. P.; Avramenko, B. A.: "Strong magnetic fields of scattering in systems from the highly anisotropic magnetic materials", Physics of Metals and Metallurgical Science, 2004, Volume 97, No. 3, pp. 15-23.

3. Gh. lacob, Ay. D. Ciochina, O. Bredetean: "High Gradient Magnetic Separation Ordered Matrices", European Cells and Materials, Vol. 3. Suppl. 2, 2002 25 (pp. 167-169), ISSN 1473-2262.
4. European patent No. 0 429 700, published May 4, 1995.
5. European patent No. 0 589 636, published Feb. 8, 2000.

The invention claimed is:

1. A method of creating a zone of a permanent, high-gradient magnetic field in a Kittel open domain structure, the method comprising:

providing two permanent magnets, each of the permanent magnets having an upper side, a lower side, and a lateral side with the lateral sides of the permanent magnets joined together, the permanent magnets having directions of magnetic field polarity being opposite to one another, a magnetic anisotropy of the permanent magnets essentially exceeding the magnetic induction of a material of the permanent magnets, mounting the permanent magnets on a common base comprising a soft magnetic material that is connected to the lower sides of the permanent magnets, wherein, on the upper side of the permanent magnets, magnetic soft plates with a uniform thickness that are substantially thinner across a length thereof than each of the two permanent magnets are placed to form a narrow gap located immediately above upper edges of the joined lateral sides of the permanent magnets, and wherein the magnetic soft plates facilitate the permanent, high-gradient magnetic field at the narrow gap by increasing a gradient of the magnetic field of the permanent magnets.

2. The method of claim 1, wherein the thin plates are made of vanadium permendur.

3. The method of claim 2, wherein the narrow gap between the magnetic soft plates has a width in a range of 0.01-1.0 mm, the gap being located symmetrically about a plane, along which the lateral sides of the permanent magnets are joined.

4. The method of claim 1, wherein the narrow gap between the magnetic soft plates has a width in a range of 0.01-1.0 mm, the gap being located symmetrically about a plane, along which the lateral sides of the permanent magnets are joined.

5. The method of claim 1, further comprising:

moving a material via a substrate along a direction perpendicular to the longitudinal axis of the gap.

6. The method of claim 5, wherein the substrate is a horizontal plate connected to a generator of mechanical oscillations.

7. The method of claim 1, wherein the permanent magnets are made of neodymium-iron-boron, samarium-cobalt, or iron-platinum.

8. The method of claim 1, further comprising:

providing one or more additional permanent magnets, identical to the permanent magnets, wherein the lateral sides of three or more additional permanent magnets and permanent magnets are joined in series to form two or more narrow gaps located immediately above upper edges of the joined lateral sides of the additional permanent magnets and permanent magnets.

9. The method of claim 1, wherein the permanent magnets have a substantially rectangular shape.

10. The method of claim 1, wherein a ratio of the thickness of the magnetic soft plates with respect to a thickness of the two permanent magnets is about 1:25.

11. The method of claim 1, wherein a ratio of the thickness of the magnetic soft plates with respect to a thickness of the two permanent magnets is about 1:50.

12. The method of claim 1, further comprising:

providing a non-magnetic substrate for the material being separated above the narrow gap, wherein the thickness of the magnetic soft plates is 0.01-1.0 mm.

* * * * *